US005970567A

United States Patent [19]

Hirse

[11] Patent Number: 5,970,567

[45] Date of Patent: Oct. 26, 1999

[54] FLOOR MOPPING DEVICE

[76] Inventor: Gernot Hirse, Franz-Simon-Str. 29, D-65934 Frankfurt am Main, Germany

[21] Appl. No.: 08/986,790

[22] Filed: Dec. 8, 1997

[30] Foreign Application Priority Data

Dec. 7, 1996 [DE] Germany ..... 196 50 867

[51] Int. Cl.[6] ..... A47L 13/20; A47L 13/255

[52] U.S. Cl. ..... 15/229.2; 15/147.1; 15/150; 15/228

[58] Field of Search ..... 15/147.1, 147.2, 15/150, 228, 229.1–229.9

[56] References Cited

U.S. PATENT DOCUMENTS

| | | | |
|---|---|---|---|
| 90,562 | 5/1869 | Law | 15/229.1 |
| 1,438,644 | 12/1922 | Hill | 15/150 |
| 4,962,563 | 10/1990 | Bachar | 15/147.1 |
| 5,481,777 | 1/1996 | Nenninger | 15/229.2 |

FOREIGN PATENT DOCUMENTS

| | | |
|---|---|---|
| 268 464 | 12/1913 | Germany . |
| 74/15600 | 1/1975 | Germany . |
| 41 09 142 | 9/1992 | Germany . |
| 195 03 572 | 7/1996 | Germany . |

*Primary Examiner*—Randall E. Chin

*Attorney, Agent, or Firm*—Burns, Doane, Swecker & Mathis, L.L.P.

[57] ABSTRACT

A floor mop includes a handle, and a mop holder fixed to the handle and carrying a flat mop. The mop comprises two mop halves each mounted on a mop-carrying surface of the holder. The mop-carrying surfaces are located on respective holder arms which are able to swing between raised and lowered positions. In the raised position the mop-carrying surfaces are inclined downwardly and outwardly. The mop assumes a tapered shape when held in the raised position, so that it can easily be introduced into a relatively small squeezing device for being wrung out. Instead of being disposed on swingable arms, the mop-supporting surfaces could be disposed in a one-piece holder and permanently arranged in a downwardly and outwardly inclined state.

17 Claims, 5 Drawing Sheets

FLOOR MOPPING DEVICE

BACKGROUND OF THE INVENTION

The invention concerns a damp floor wiper device with a handle which has mounted crosswise on its lower end a long mop holder with a flat mop.

Such damp floor wiper devices, which can be designated as a wiping or cleaning mop, serve to damp-wipe a floor surface, stairway, staircase and similar surfaces. After each wiping action the mop made of absorbent material is rinsed in a pail of cleaning water whereby the mop absorbs water. The excess amount of water must be squeezed out before the next wiping action.

Damp floor wiper devices designed as round mops incorporate a rotationally symmetrical mop. Because of this shape the mop can be easily inserted into a squeezing device supported on a pail having the shape of a sieve basket. This squeezing basket is relatively light and simply constructed; due to its slight external dimensions it can be supported on a customary pail or also on a long pail which due to its shape and dimensions can even be placed on stair steps.

Such round mops, however, have the disadvantages that they can not, or can only with difficulty, be guided into corners or niches and they manifest a relatively small wiping area which normally is less than the customary depth of a stair step. In particular, the width in which a pressing force can be exerted during a mopping action is determined by the relatively small diameter of the mop holder on which the round mop is attached.

Damp floor wiper devices of the type indicated above, having a long mop holder and a flat mop extending the entire length of the long mop holder entail, on the contrary, the advantage, that they have a wide wiping area, and a pressing force can be exerted over this entire wiping area. The flat composition of the mop and the use of a long mop holder facilitate movement of the mop into corners and niches.

Because of their width these already known damp floor wiper devices can not be squeezed out in squeezing devices suited for round, rotationally symmetrical mops. For damp floor wiper devices of the type named above a specially adapted squeezing device was therefore developed (German Document 195 03 572) which incorporates two diametrically opposite entry slots which makes it possible to push the long mop holder with the attached mop deep into the squeezing device in order to perform the desired squeezing action. Such special squeezing devices require the use of relatively wide, stable pails which cannot be placed, or placed only without sufficient safety, on stair steps. The manufacturing effort required for such squeezing devices is relatively high as compared to simple round devices. Such damp floor wiper devices are thus, in practice manufactured with relatively small mopping widths. Due to the required deep submersion depth of the squeezing device in the pail, there is only a relatively low depth of the pail available for water.

The squeezing out of relatively wide, flat wiping mops customarily occurs by means of special squeezing devices which are housed in containers that are also provided. These squeezing devices are relatively heavy and expensive, so that in order to obtain the required stability the container must also be constructed as large and heavy. Therefore these containers and squeezing devices are frequently designed as a wheeled unit. These wheeled units can not be placed on stairways; they are only used in commercial areas where there are relatively large surfaces to clean and only a few stairs.

In another previously known damp floor wiping device (German Document 41 09 142) a mop designed as a one-piece wiping cloth stretched between the ends of two mop holder arms is squeezed by a long squeezing device, after the two mop holding arms are folded against each other. Squeezing in a round squeezing device is not envisioned.

In another previously known damp floor wiper device (German Document 268 464) the mop designed as a one-piece wiping cloth is carried by wire cable which is stretched between the ends of two foldable arms. When the arms and the wire cable are folded together, the mop must be wrung out by hand.

A previously known damp floor wiping device (German Document GM 74 15 600) incorporates a one-piece sponge which is attached to two halves of a mount which fold toward each other and squeezed between the in a pincer-like fashion.

It is, therefore, the task of this invention to create a damp floor wiper device with a large mop width while retaining the advantages of the previously known, simple, round squeezing device and with which the pressing force can be exerted across a large width.

SUMMARY OF THE INVENTION

The task will be accomplished in the invention by a mop consisting of two halves, each of which is supported on a mop carrying edge of the mop holder, by a mop carrying surface inclined downwardly and outwardly, at least in the raised position of the mop holder. The height of each mop headpiece is at least 2 cm.

This inclined arrangement of both mop-carrying surfaces, at least in the raised position of the mop holder, means that strings or strips of the mop extending from the headpieces of both mop halves with each being positioned on the respective mop-carrying edge do not hang vertically in the raised position of the mop but instead converge downward, so that the bundle of wet strings or strips taper when hanging. This tapered bundle can be inserted into a relatively narrow squeezing device and can be wrung out and squeezed by turning and pressing.

When a damp mop freed from excess water in this manner is placed on the floor surface to be cleaned, it unfolds to its full width so that a mopping action can be performed in the customary manner as with a flat, broad mop. The pressing force exerted on the mop holder effectively acts across the entire width of the mop.

Since the bottom ends of the bundle of mop strings or strips tapers in the raised, wet position, the mop can almost be treated like a round mop for the squeezing operation, i.e., the mop can be squeezed out in a customary, rotationally symmetrical squeezing device which is supported on a narrow pail which can also be set down on stair steps. The rotationally symmetrical shape of the squeezing device makes it possible to turn the complete mop into itself and thereby wring it out to a great extent, whereby only a relatively slight pressing force must be exerted.

It is thereby not required to make a previously determined number of revolutions and/or to maintain a given turning position of the mop through an insert slot. These squeezing devices constructed as simple, round, sieve-like devices manifest only a relatively slight depth and can therefore be supported on a small, light and easy to handle pail.

The mop holder is simply constructed and can be produced easily and cheaply; its weight is slight.

The two inner ends of the mop-carrying surfaces are spaced apart. Since the two mop halves are separated from each other and their headpieces are positioned at a distance to each other, the downward, tapered alignment of the strings or strips of the two mop halves is thereby supported. The replacement of the mops is also facilitated, because two separate mop halves can be replaced. Despite the division of the mop into two mop halves whose headpieces are positioned at a distance to each other, no gap appears between both mop halves when wiping.

A preferred embodiment of the invention envisions two mop-carrying surfaces constructed on respective mop holder arms, each arm being able to swing between a horizontal position and a downwardly inclined, position around a swivel pin extending crosswise to the long axis of the handle. In the raised position of the damp floor wiper device these mop holder arms assume their inclined positions and thereby swing the two attached mop halves toward each other, so that the bundle of strings or strip hanging down from both mop halves tapers. As soon as the mop is placed on the floor, both mop halves swing into the horizontal position and together form a straight, horizontal holder on which the two mop halves are attached by horizontal headpieces from which the strings or strips hang vertically downward.

The two mop holder arms each preferably have stopping faces which come to rest in both swing positions of the mop holder arms against an opposite surface of a mop-carrying center piece attached to the handle. The two mop holder arms are thereby simply fixed in the horizontal position for the wiping action, so that the required pressing force can be exerted for the wiping action.

The two mop holder arms can be positioned on the mop-carrying center piece to swing freely, whereby they can be brought to their two swinging end positions by the pressure required for wiping or by gravity, respectively.

Instead of providing mop holder arms that can swing, it is also possible for the two mop-carrying surfaces to be constructed on a one-piece mop holder and therefore constantly retain their inclined orientation position. During the wiping action, the bundle of strings or strips from both mop halves still manifests a sufficiently large width.

BRIEF DESCRIPTION OF THE DRAWING

The objects and advantages of the invention will become apparent from the following detailed description of preferred embodiments thereof in connection with the accompanying drawings in which like numerals designate like elements, and in which.

DETAILED DESCRIPTION OF PREFERRED

Embodiments of the Invention

Figure 1:
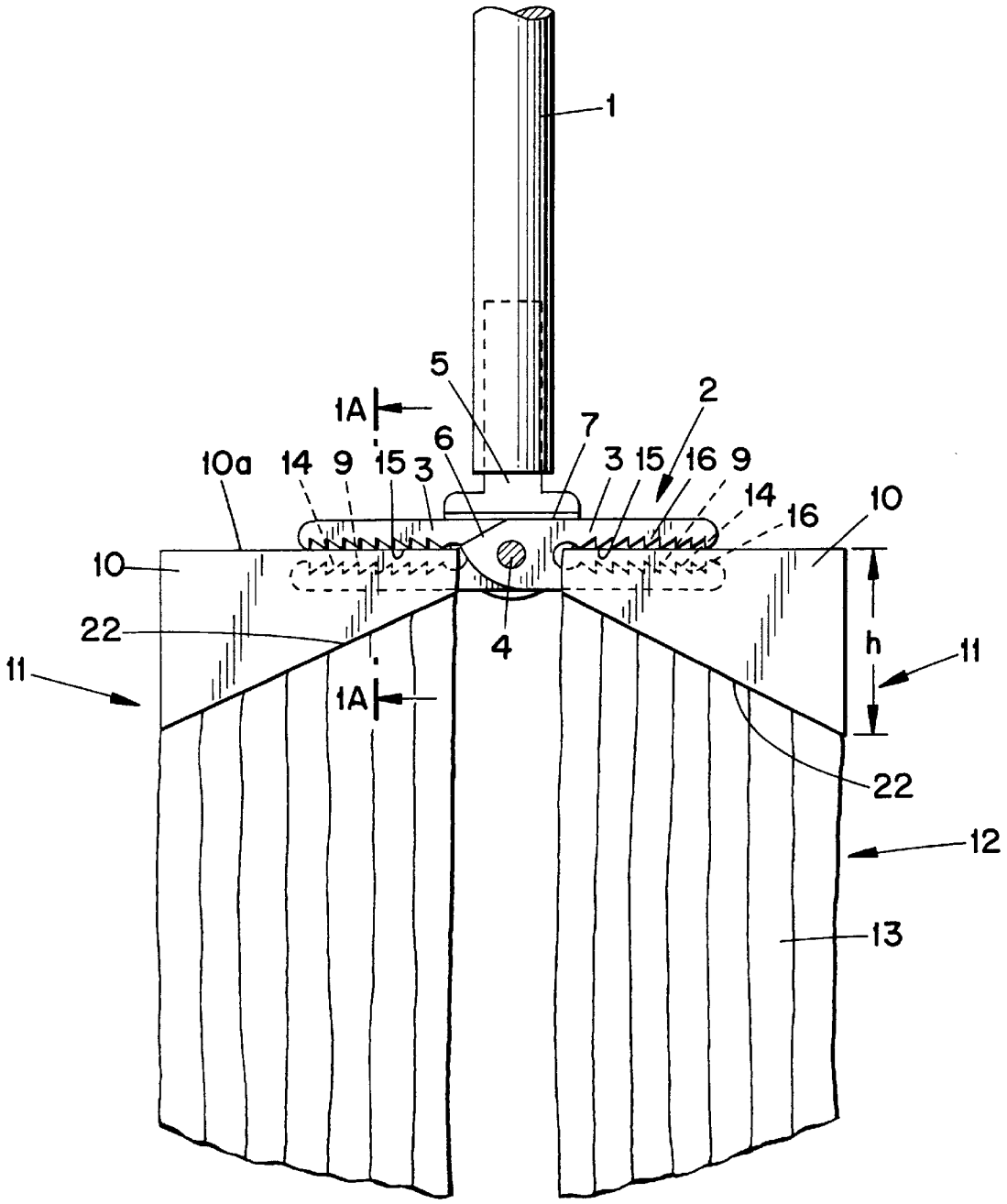
FIG. 1 is front view of a damp floor wiper device according to a first preferred embodiment of the invention in its ready position.
Figure 2:
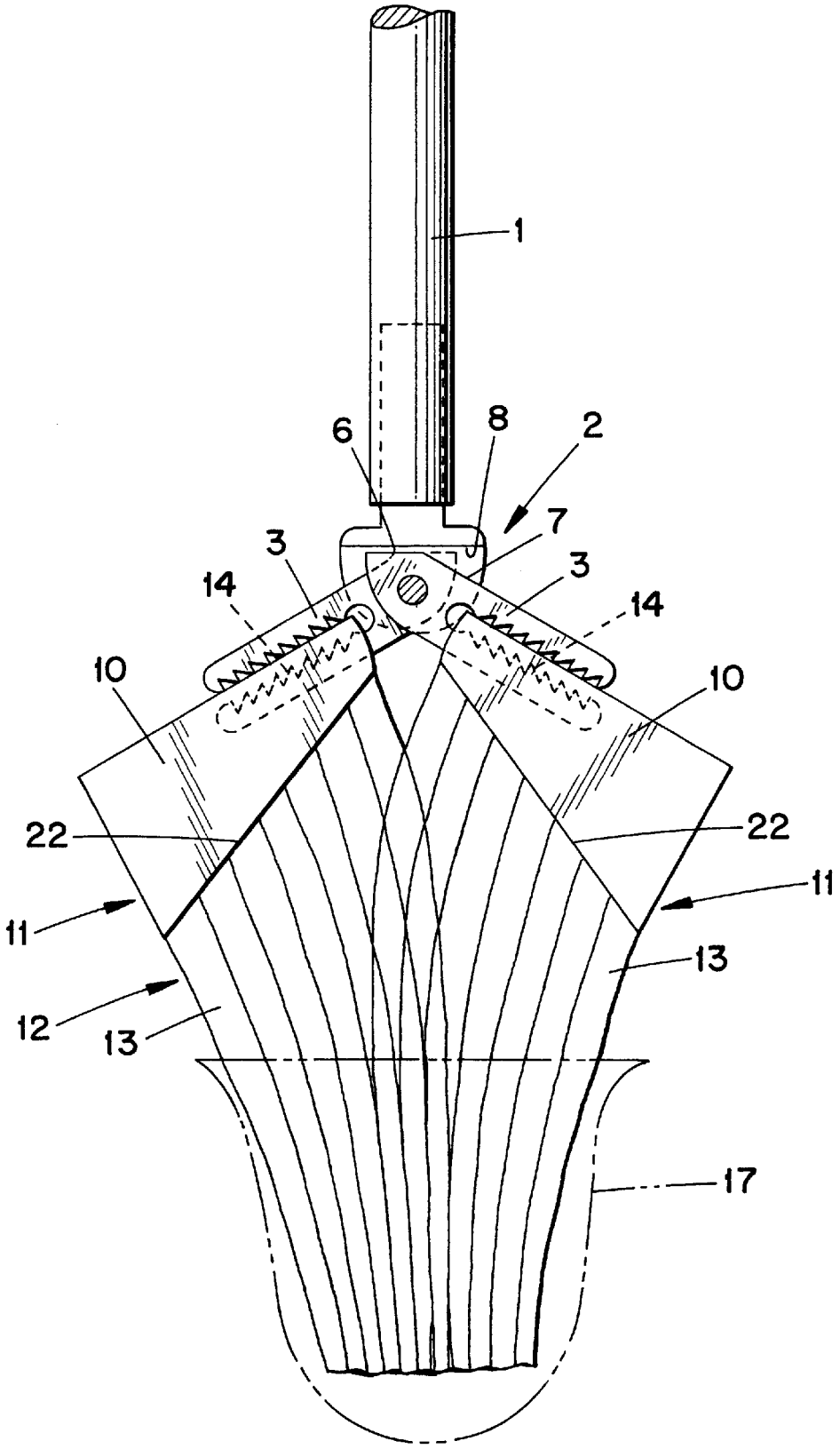
FIG. 2 shows the damp floor wiper device of FIG. 1 in the raised position, whereby a squeezing device in which the mop is inserted is indicated by dotted lines.

The first preferred embodiment of a damp floor wiper device of FIGS. 1 and 2 incorporates a handle 1 on whose lower end a mop holder 2 is attached which extends laterally of the handle axis. The mop holder 2 incorporates two mop holder arms 3 which are mounted to the handle by a swivel pin 4. Thus, the arms 3 can swing freely about an axis of the pin 4 extending perpendicularly to the handle axis and assume either the horizontal position shown in FIG. 1, or the position shown in FIG. 2 in which the two mop holder arms extend downwardly and outwardly at an obtuse angle to the handle axis.

The pin 4 is carried by a mop holder center piece 5, which is attached, preferably so that it can be easily replaced, on the handle 1.

Each mop holder arm 3 incorporates two stopping faces 6 and 7. The mop carrying center piece 5 is outfitted with an opposing surface 8 oriented perpendicular to the handle axis. That surface 8 is abutted by stopping faces 7 or 6 of the arms 3, depending upon whether the handle 1 is in a raised (FIG. 2) or lowered (FIG. 1) state.

Figure 1A:
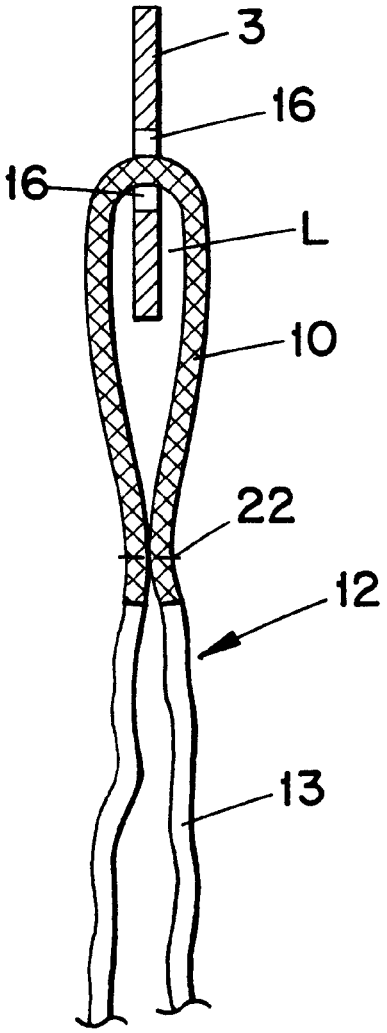
FIGS. 1A and 4A shows a mop half folded over and mounted on the device.
Figure 4A:
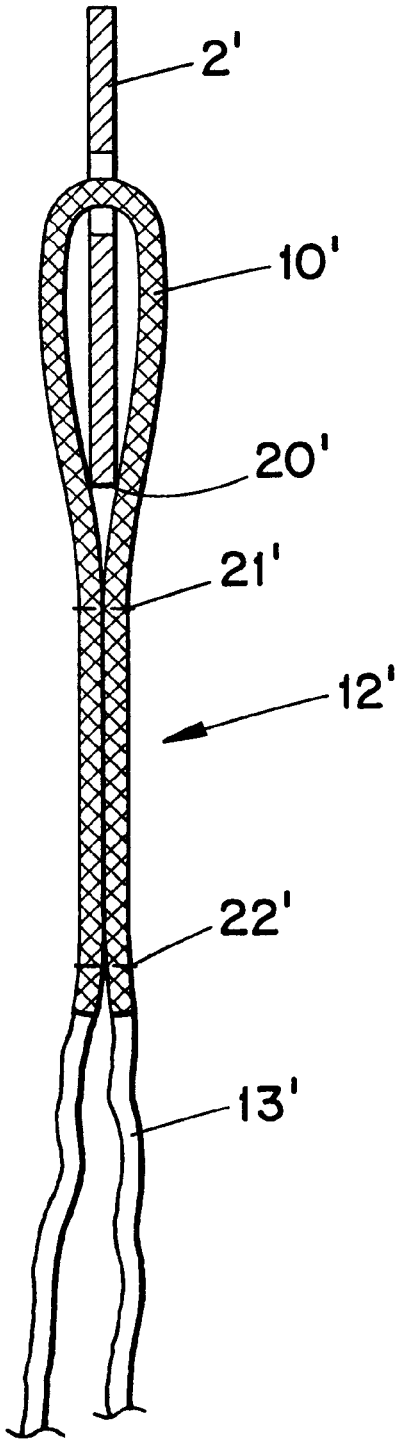

The mop is in the form of two halves 11 that are connected to respective arms 3. Each mop half 11 is formed of a textile material that is folded over on itself and stitched together along a seam 22 (see FIG. 1A) to form a headpiece 10. The lower portions of the material are slit numerous times to form strips 13. Each headpiece 10 forms a loop L which enables a mop half of the mop 12 to be mounted.

Each mop holder arm 3 has an insert slot 9 opening laterally outwardly into which the loop L of a headpiece 10 can be inserted. The two mop halves 11 together form the mop 12. The strings or strips 13 that hang down from each headpiece 10 comprise absorbent material. Instead of that material, the mop could incorporate rags.

The lower edge of the insert slot 9 forms a mop-carrying edge surface 14 and is equipped with holding teeth 16 directed inwardly toward the axis of handle 1. The opposite upper slot edge 15 is spaced from the surface 14 and also includes teeth 16. The holding teeth 16 serve to secure the headpiece 10 of the mop half 11 after the latter is inserted into the insert slot 9.

When the damp floor wiper device is raised, the two mop holder arms 3 (and surfaces 14) swing downwardly by gravity and assume a laterally retracted position shown in FIG. 2. The laterally outer ends of the two mop halves 11 are thus swung down and toward each other so that the bundle of strings or strips 13 assumes a downwardly tapered shape as shown in FIG. 2. In this condition, the mop 12 can be placed more easily in a relatively small pail for rinsing. Also, the mop 12, which after rinsing is full of water, can easily be placed (due to its tapered shape) into a relatively small, round squeezing device 17 whose contour is indicated in FIG. 2 by dotted lines. By a combination of turning and vertical pressure, the mop 12 is wrung out and squeezed, so that excess water is drained off. In response to the damp mop 12 being replaced on the surface to be cleaned, the two mop holder arms 3 are pushed upwardly to the horizontal position shown in FIG. 1. The mop 12 thus unfolds into its laterally extended (full width) position and can be guided with sufficient pressing force over the surface to be wiped. The higher, stiff headpiece 10 results in better guiding of the mop, even in the area extending beyond the side of the mop holder arm 3.

As shown in the figure, the two mop halves 11 project beyond the laterally outer ends of the mop-carrying edge surfaces 14 of the mop holder arm 3. The effective lateral width of the mop 12 is thus greater than the lateral distance between the ends of the mop holder arms 3; nonetheless the pressing force is exerted by the headpieces 10 across the entire mop width. The flexibility of the protruding mop simplifies the turning motion inside the squeezing device.

Figure 3:
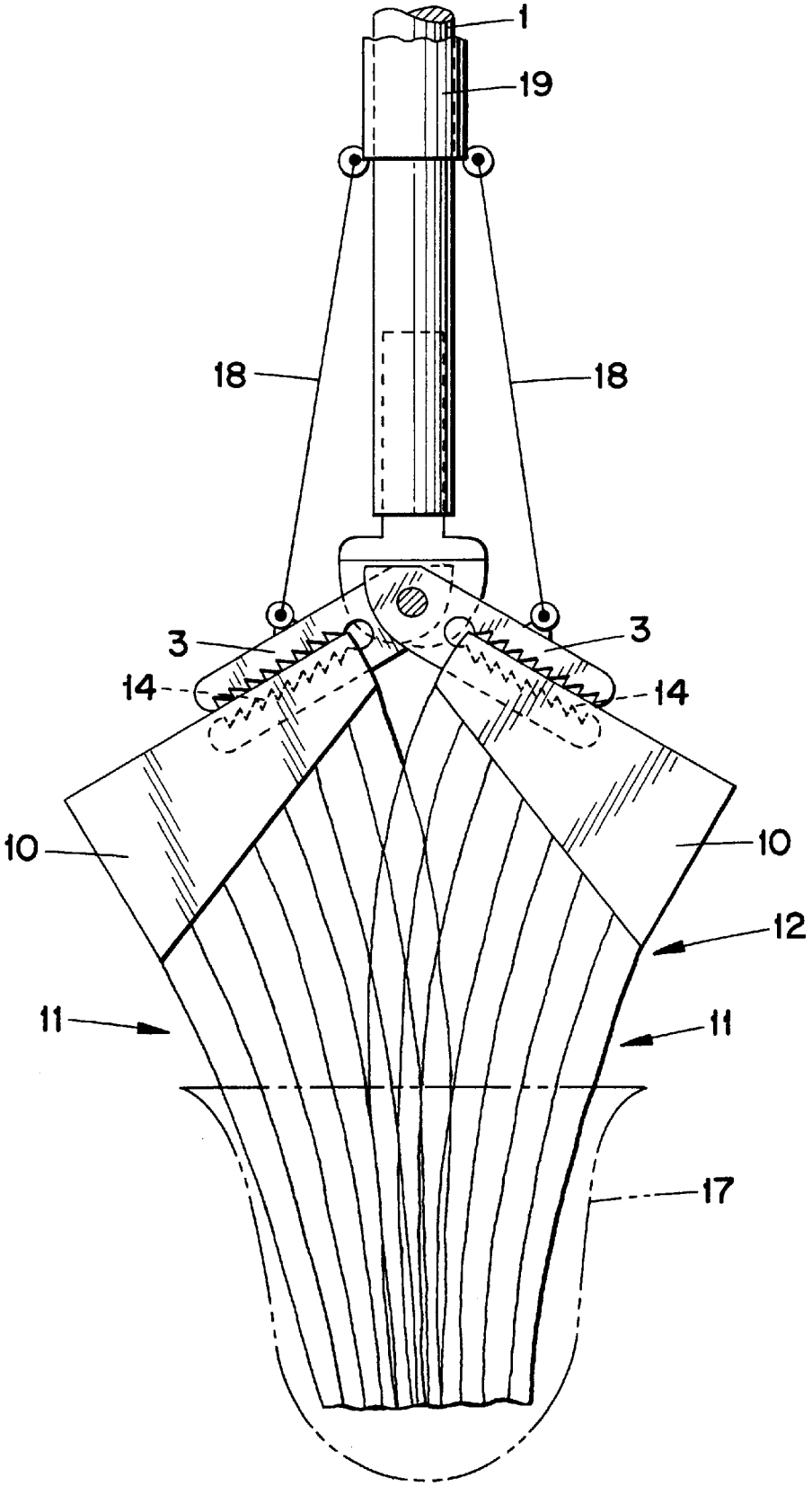
FIG. 3 is a second preferred embodiment of a damp floor wiper device in the raised position.

A second embodiment of a damp floor wiper device shown in FIG. 3 differs from the embodiment of FIGS. 1 and 2 in that the two movable mop holder arms 3 are connected by means of respective pulling devices 18, for example wires, to a manually movable positioning member 19 in the form of a sliding sleeve. The two mop holder arms 3 can thereby be moved to the laterally extended position before placement of the mop 12 on the floor, by raising the sleeve 19, and can be held in that position, so that the mop holder arms 3 do not swing downward even when the mop 12 is raised for a short time.

Figure 4:
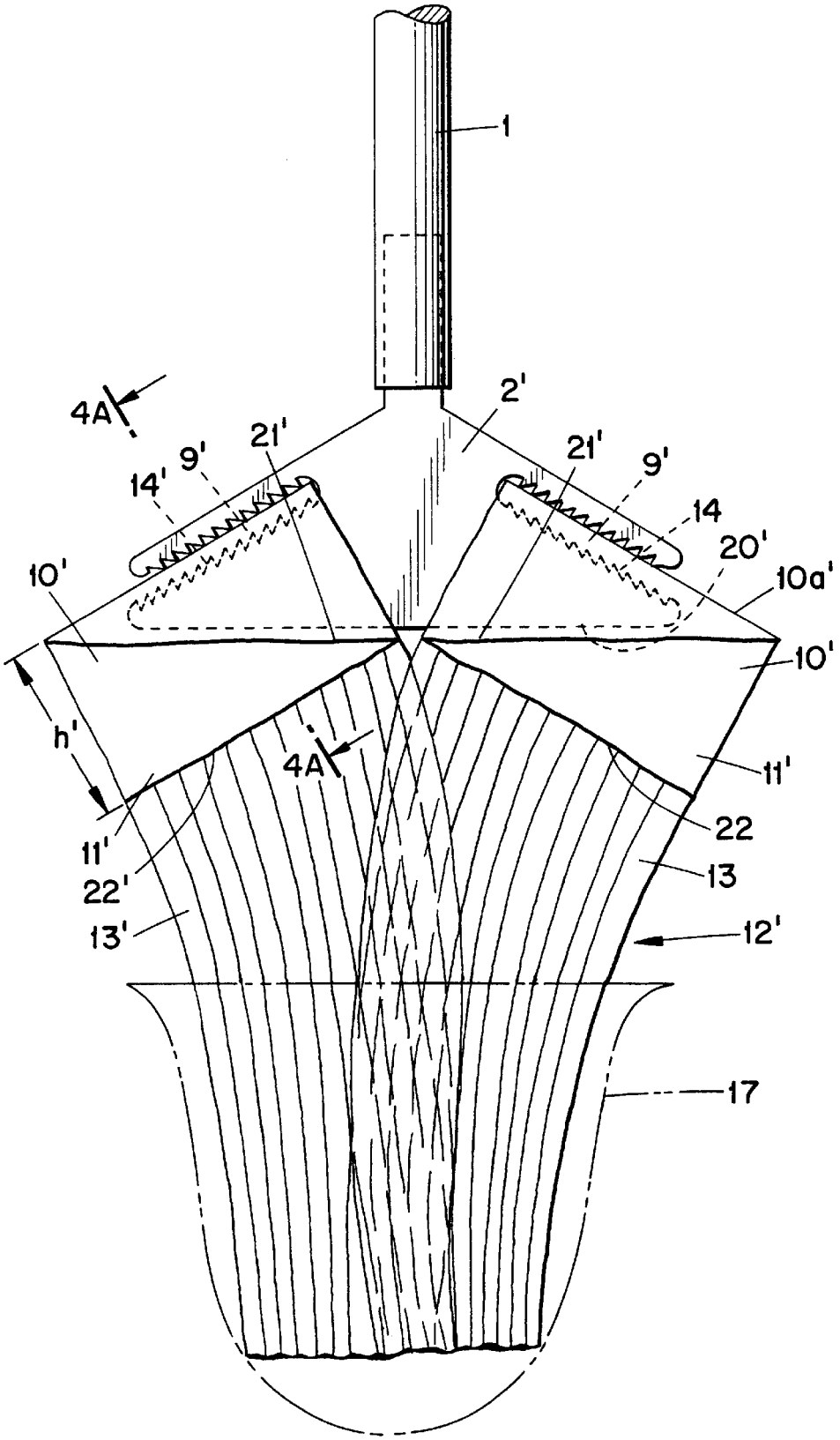
FIG. 4 is a third preferred embodiment of a damp floor wiper device in the raised position.

A third embodiment of a damp floor wiper device is shown in FIG. 4. In that device, both insert slots 9' are formed in a rigid, one-piece mop holder 21 which is attached to the handle 1. Each of the slots 9' extends outwardly and downwardly and receives one mop half 11'. The mop halves are retained by teeth 16' formed on the walls of the slots, lower ones of the walls comprising mop-supporting surfaces 14'.

In the handle-raised position the arrangement of the insert slots 9' and the mop carrying edge surfaces 14 correspond to the arrangement of the earlier described embodiment shown in FIG. 2. If the damp floor wiper device is placed on the floor, then the strings or strips 13' of both mop halves 4' spread out, even though the two mop-carrying edges 14' remain inclined downwardly and outwardly. This is caused by the protruding part of the higher headpiece 10. The lower edge 20 of the mop holder 21 serves to press against the inner edge 21 of each mop half 11, in order to press the mop 12 against the floor during the wiping action.

Each mop half 11' is folded over to form a headpiece 10'. In the previously disclosed embodiments, the height h' of the headpiece gradually decreased in a laterally outward direction, and the seam 22 diverged from an upper edge of the headpiece in a laterally outward direction. In the FIG. 4 embodiment, however, the height h' of the headpiece 10' is uniform. Also, an additional seam 21' is provided which extends at an oblique angle relative to the upper and lower edges of the headpiece, and extends parallel to a lower edge 20' of the holder 2'. The lower edge 20' of the holder is disposed closely adjacent the seam 21' and can apply a forward or downward force thereto during a mopping operation.

Since the lower seam 22 is permanently oriented at an oblique angle relative to the axis of the handle, the strips 13 will automatically assume the tapered state shown in FIG. 4 whenever the mop is raised off the floor, thereby facilitating insertion of the mop into the squeezing device 17.

The maximum height h or h' of the headpiece 10 or 10' of the mop 12 or 12' preferably is greater than that selected for customary mops, i.e., the maximum height is preferably at least 2 cm or more.

Because of that, whenever the device is in a raised state, the upper ends of the outermost strips 13 or 13' will be located nearer to the center axis of the device than would be the case if the maximum height were shorter. That facilitates entry of the mop into the squeezing device 17. On the other hand, the top edge 10*a* or 10*a'* of the headpiece extends laterally outwardly by a relatively large distance driving a mopping operation, thereby making possible a pressing force across a relatively large width.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A mopping device comprising:

a handle;

a mop holding structure disposed at a lower end of the handle and including a pair of mop-supporting surfaces;

a mop comprised of two mop halves mounted on the holding structure, each mop half including:

a headpiece attached to the respective mop-supporting surface and having a maximum height of at least 2 cm, and flexible, absorbent strips extending downwardly from the headpiece;

each of the mop-supporting surfaces being inclined outwardly and downwardly with respect to a center axis of the handle, at least when the mopping device is raised from a floor.

2. The device according to claim 1 wherein each of the supporting surfaces has an inner end, the inner ends being spaced from one another.

3. The device according to claim 1 wherein the headpieces extend laterally beyond the respective mop-supporting surfaces.

4. The device according to claim 1 wherein the mop holding structure comprises first and second arms, a laterally inner end of each arm mounted for swinging movement about an axis extending laterally with respect to a center axis of the handle, whereby when said device is raised above a floor, laterally outer ends of the arms swing downwardly, enabling the mop-supporting surfaces to assume the downwardly and outwardly inclined state.

5. The device according to claim 4 wherein each of the arms has a stop face adapted to contact a surface carried by the handle, in the downwardly and outwardly inclined state of the arm.

6. The device according to claim 4 wherein the arms swing freely up and down.

7. The device according to claim 4 further including a manual actuator movable along the handle and attached to the arms for swinging the arms upwardly.

8. The device according to claim 1 wherein the holding structure is a one-piece rigid holder on which both of the mop supporting surfaces are formed.

9. The device according to claim 1 wherein the mop-supporting surfaces include teeth directed inwardly generally toward the axis of the handle for retaining the headpieces.

10. The device according to claim 1 wherein each of the mop-supporting surfaces comprises one wall of a respective slot formed in the holding structure, the headpieces being mounted in respective ones of the slots.

11. The device according to claim 10 wherein at least one of the walls includes teeth directed inwardly generally toward the axis of the handle, for retaining the headpiece in the respective slot.

12. The device according to claim 11 wherein both of the walls include the teeth.

13. The device according to claim 1 wherein each mop half is formed of a textile material folded over on itself, the folds being attached together along a seam to form a loop, the loops being attached to the holding structure, the seam inclined downwardly and outwardly.

14. The device according to claim 1 wherein a height of each headpiece increases gradually toward a laterally outer end thereof.

15. The device according to claim 1 wherein a height of each headpiece is constant along a lateral extend of the headpiece.

16. A mopping device comprising:

a handle;

a mop holder disposed at a lower end of the handle and including first and second arms, a laterally inner end of each arm mounted for swinging movement about an axis extending laterally with respect to a center axis of the handle, each arm carrying a mop-supporting surface; and a mop mounted on the holder and comprised of two mop halves, each mop half including a headpiece attached to a respective mop-supporting surface, and flexible, absorbent strips extending downwardly from the headpiece; each of the mop-supporting surfaces being inclined outwardly and downwardly with respect to a center axis of the handle, at least when the mopping device is raised from a floor, whereby when said device is raised above a floor, laterally outer ends of the arms swing downwardly, enabling the mop-supporting surfaces to assume the downwardly and outwardly inclined state.

17. A mopping device comprising:

a handle;

a one-piece rigid mop holder disposed at a lower end of the handle and including two mop-supporting surfaces; and a mop mounted on the mop holder and comprised of two mop halves, each mop half including a headpiece attached to a respective mop-supporting flexible, absorbent strips extending downwardly from the headpiece;

each of the mop-supporting surfaces being permanently inclined outwardly and downwardly with respect to a center axis of the handle.

* * * * *